US008213014B1

(12) United States Patent
Willemse

(10) Patent No.: US 8,213,014 B1
(45) Date of Patent: Jul. 3, 2012

(54) HIGH SPEED COUNTER AND INSPECTOR FOR MEDICAMENT AND OTHER SMALL OBJECTS

(76) Inventor: Werner Willemse, San Diego, CA (US)

( * ) Notice: Subject to any disclaimer, the term of this patent is extended or adjusted under 35 U.S.C. 154(b) by 958 days.

(21) Appl. No.: 12/218,689

(22) Filed: Jul. 17, 2008

Related U.S. Application Data

(60) Provisional application No. 60/961,337, filed on Jul. 21, 2007, provisional application No. 60/997,629, filed on Oct. 4, 2007.

(51) Int. Cl.
*G01N 21/00* (2006.01)

(52) U.S. Cl. ..... 356/440

(58) Field of Classification Search ..... None
See application file for complete search history.

(56) References Cited

U.S. PATENT DOCUMENTS

| | | | |
|---|---|---|---|
| 1,047,316 | A | 12/1912 | Sicka |
| 2,632,588 | A | 3/1953 | Hoar et al. |
| 3,789,194 | A | 1/1974 | Kirby et al. |
| 4,675,520 | A | 6/1987 | Harrsen et al. |
| 4,743,760 | A | 5/1988 | Giles et al. |
| 5,313,508 | A | 5/1994 | Ditman et al. |
| 5,317,645 | A | 5/1994 | Perozek et al. |
| 5,768,327 | A | 6/1998 | Pinto et al. |
| 6,684,914 | B2 | 2/2004 | Gershman et al. |
| 7,395,841 | B2 | 7/2008 | Geltser et al. |

OTHER PUBLICATIONS

U.S. Appl. No. 60/961,337, filed Jul. 21, 2007, Willemse et al.
U.S. Appl. No. 60/997,629, filed Oct. 4, 2007, Willemse et al.

*Primary Examiner* — Gregory J Toatley
*Assistant Examiner* — Amanda Merlino
(74) *Attorney, Agent, or Firm* — John R. Ross; John R. Ross, III

(57) ABSTRACT

An apparatus for counting and inspecting medicaments and other small objects whereby the objects are poured into a funnel. From the funnel, the objects fall onto the sharp point of a concentric cone, dispersing the objects on their way outwards causing dispersion and lateral singulation. Objects are vertically singulated when falling from the bottom edge of the cone. Objects are circularly scanned from just below the edge of the cone. A high speed processor resolves the scanned path in sufficiently small segments to determine width, and angular position measurements of the objects. The height measurements are resolved by the number of scans that show the objects in the same location before falling out of view. By calculations based on recurring sequential scans of objects at the same location, a total count can be made as well as sizes and irregularities of the objects.

6 Claims, 3 Drawing Sheets

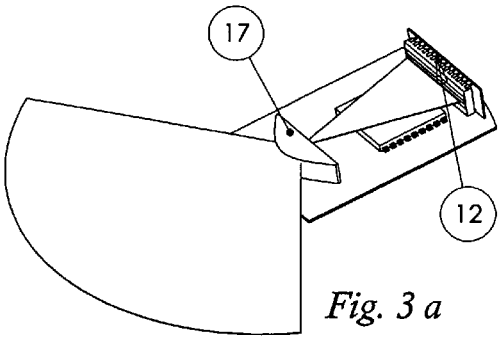
Fig. 3 a
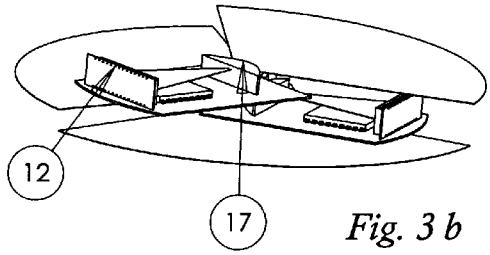
Fig. 3 b
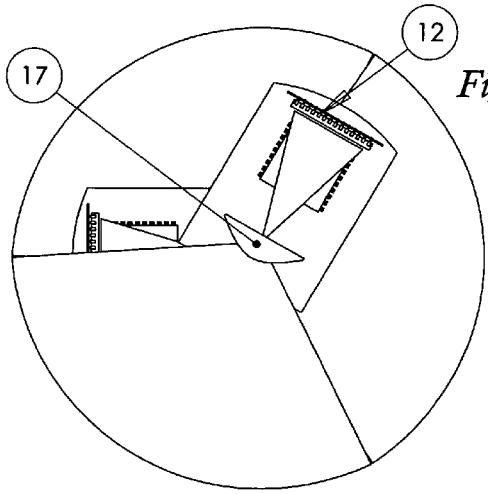
Fig. 3 c
Fig. 3 d
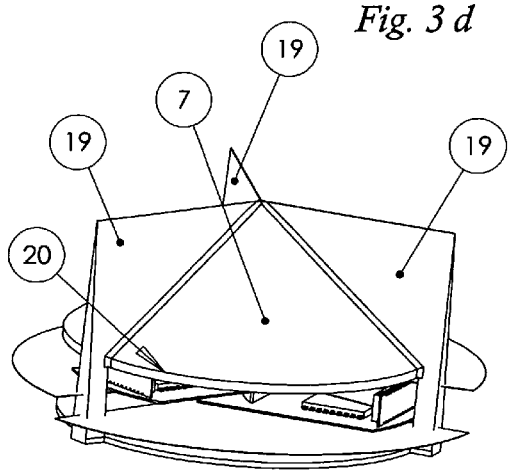

HIGH SPEED COUNTER AND INSPECTOR FOR MEDICAMENT AND OTHER SMALL OBJECTS

CROSS REFERENCE TO RELATED APPLICATIONS

This application claims priority from U.S. provisional patent application No. 60/961,337 Filing Date Jul. 21, 2007 Willemse et. al., and No. 60/997,629 Filing Date Oct. 4, 2007 Willemse et. al the entirety of which is hereby incorporated by reference.

U.S. Pat. No. 7,395,841 Jul. 8, 2008 Geltser et. al.
U.S. Pat. No. 6,684,914 Feb. 2, 2004 Gershman et. al.
U.S. Pat. No. 5,768,327 Jun. 16, 1998 Pinto et. al.
U.S. Pat. No. 5,317,645 May 31, 1994 Perozek et. al.
U.S. Pat. No. 5,313,508 Jun. 7, 1994 Ditman et. al.
U.S. Pat. No. 4,743,760 May 10, 1988 Giles et. al.
U.S. Pat. No. 4,675,520 Jun. 23, 1987 Hansen et. al.
U.S. Pat. No. 3,789,194 Jan. 29, 1974 Kirby et. al.
U.S. Pat. No. 2,632,588 Mar. 3, 1953 Hoar et. al.
U.S. Pat. No. 1,047,316 Dec. 12, 1912 Sicka

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND OF THE INVENTION (1) Field of Invention

Pharmacies usually dispense a specific quantity of medicaments from bulk supply containers into smaller vials per each patient's prescription. These medicaments have to be precisely counted before being dispensed into vials. Several inventions have been made over the last few decades to enable quick and accurate counting of objects.

(2) Description of the Related Prior Art Including Information Disclosure

Retail pharmacies typically order large amounts of medicaments such as capsules and tablets from its suppliers. These medicaments are stored in bulk supply bins from where the correct number of medicaments are retrieved and counted by pharmacy staff when filling patients' prescriptions. Historically the medicaments had to be manually counted and dispensed into patient vials. Prior art indicates inventions exist that assist at automating the counting of discrete objects. All of these inventions have limitations.

Single Location Transmitter/Receiver Type Sensors:

In 1969 U.S. Pat. No. 3,618,819 was filed by Blackburn et. al. in which an electronic counter is described that utilizes a single optical sensor in order to optically count discrete components traveling in single file down a path or tube. The limitation of the Blackburn invention is that the objects have to pass by the sensor in single file to avoid counting errors. In the Blackburn et. al. patent no recommendation is provided to bring a disorderly flow of objects into single file in order for the objects to be accurately counted. In 1974 a patent was filed by Kirby (U.S. Pat. No. 3,789,194) which outlines an invention which attempts to address the problem created by objects traveling in a disorderly formation. When multiple objects pass by a single optical sensor while touching one another, or when one object is obscured by another object, the sensor will detect only one object. The Kirby (U.S. Pat. No. 3,789,194) invention attempts to overcome this counting problem by dispersing the disorderly flow of objects into as many as 16 separate paths. Each of these paths still however had only one optical sensor. Although the Kirby invention (U.S. Pat. No. 3,789,194) tends to distribute the disorderly flow of objects thereby reducing the chance of objects obscuring one another at the sensor, an inherent design flaw still remains. After the overall flow of objects are dispersed to multiple smaller paths, each individual smaller flow of objects are then once again constrained by a narrow path that passes by single discrete sensor, thus reintroducing the likelihood of objects obscuring one another as they pass through the narrow sensing region simultaneously.

Multiple Discrete Transmitter/Receiver Type Area Sensors:

In 1985 Harrsen et. al. (U.S. Pat. No. 4,675,520) filed a patent for an invention that describes an improved sensor type. The Harrsen et. al. patent comprises of a multitude of sensors arranged side by side such that the sensors would be able to detect multiple objects passing through the sensing region simultaneously provided that the objects were sufficiently laterally separated from one another, and that the objects do not obscure one another. The Harrsen et. al. invention introduced intelligence that previous single sensor type inventions lacked. As a result of the large sensing region described by Harrsen et. al. objects can pass through the sensing region laterally dispersed thereby reducing the chance that objects obscure one another. In 1991 two more patents were filed for inventions similar to the Hansen et. al. invention by Perozek et. al. (U.S. Pat. No. 5,317,645) and Ditman et. al. (U.S. Pat. No. 5,313,508).

BRIEF SUMMARY OF THE INVENTION

The system consists out of four functional segments. The first functional segment receives, and evenly disperses the objects to be counted. The second functional segment is a scanning optical sensor that detects the evenly distributed objects passing through an annular sensing region. The third functional segment recollects the evenly dispersed objects into one holding area. The fourth functional segment is an electronic digital signal processor that analyzes the electrical signal received from the optical sensor. The digital signal processor calculates the quantity and size of objects detected and displays the metrics.

Objects to be counted are applied to a funnel shaped hopper centrally located at the top of the device. An orifice at the lowest central point in the funnel shaped hopper allows the objects to fall onto the pointed end of a cone. The cone separates and disperses the objects as gravity causes them to slide radially outward from the pointed end of the cone towards the edge of the cone. Objects thus sliding down the side of the cone further disperse and singulate, until reaching the edge from where the objects freefall. The sudden vertical acceleration of the objects falling from the edge of the cone's edge vertically singulates objects.

A rotary scanner positioned below the bottom edge of the cone, repeatedly scans the annular region below and surrounding the dispersion cone. The high speed scanning process is essentially a repeated sequential operation, whereby each falling object is scanned numerous times. By monitoring the sensing area, the geometry and progress of objects passing through the sensing area are evaluated, quantified and displayed to the user. The counted and evaluated objects are finally collected in the holding tray.

BRIEF DESCRIPTION OF THE SEVERAL VIEWS OF THE DRAWINGS

FIG. 3*a* Isometric view of an alternative embodiment optical sensor using a linear sensor array with a 120 degree viewing angle.

FIG. 3*b* Isometric view of three of the optical sensors depicted in FIG. 3*a* staggered above one another each oriented to view a portion of the complete 360 degree.

FIG. 3*c* Plan view of the components depicted in FIG. 3*b*.

FIG. 3*d* Isometric view of the components depicted in FIG. 3*b* including the dispersion cone 7 positioned above the sensor assembly.

DETAILED DESCRIPTION OF THE INVENTION

Figure 1A:
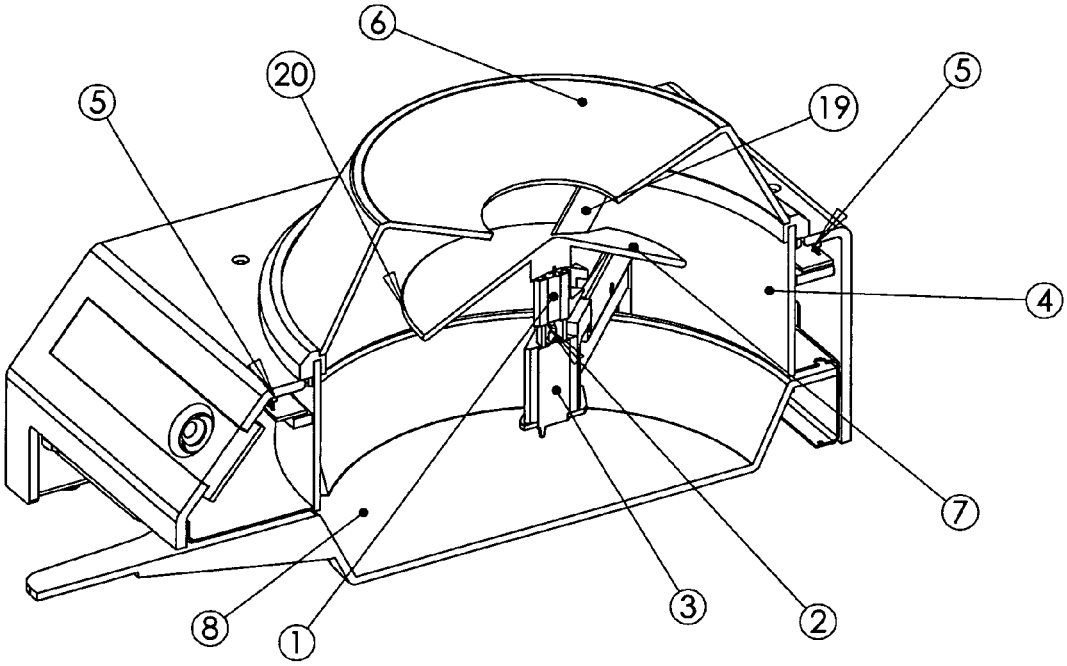
FIG. 1*a* Isometric cross-section view of the invention showing the standard embodiment of the optical sensor.

FIG. 1*a* shows a cross-sectional view of the general system. Objects to be counted are poured into the funnel shaped hopper 6. The hopper 6 guides the objects to be counted towards the central orifice at the lowest point in the hopper from where the objects fall onto the pointed end of a cone 7. The cone 7 is supported from the frame of the system by means of pillar 19. Objects falling from the orifice onto the cone slide radially outwards over the surface of the cone towards the lower outermost edge 20 of the cone. Since the general radius of the cone increases towards the lower edge of the cone, objects that started out adjacent to one another at the point of the cone will tend to gradually become separated as they slide towards the bottom edge 20 of the cone. Objects transitioning over the edge 20 of the cone will instantaneously experience an increased vertical acceleration under freefall conditions. The sudden increase in acceleration of objects transitioning to freefall will facilitate the vertical separation between objects. Objects that started out clustered together at the point of the cone will therefore tend to be evenly distributed with space in between them after having fallen from the bottom edge of the cone 7.

A scanning optical sensor system positioned generally on the center line of the cone at a predetermined vertical position below the bottom edge 20 of the cone views radially to detect the falling objects. The optical sensor senses along only one radial line at a time, however by sweeping the sensing position rapidly around the entire 360 degree perimeter the entire annular sensing region is scanned. A high enough scanning frequency ensures that the entire annular region is scanned at least twice during the time that it takes an object to fall through the sensing plane.

After falling through the sensing region objects finally settle in the collection tray 8 at the bottom of the system. Tray 8 can be removed from below the system to allow objects to be poured into alternative containers such as medicament vials used by retail pharmacies.

Four Embodiments of the Optical Sensor are Provided:

Sensor Embodiment One

Figure 1B:
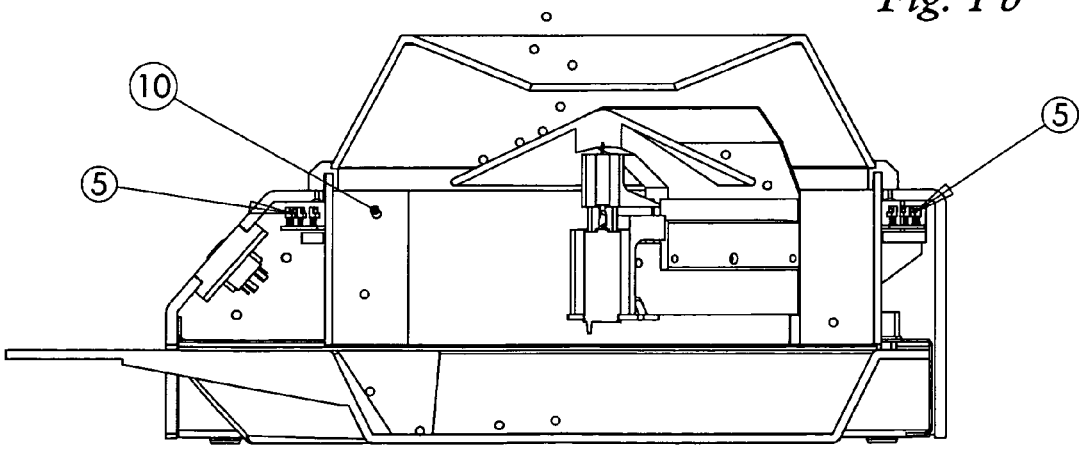
FIG. 1*b* Orthogonal cross-section view of the invention showing the standard embodiment of the optical sensor.

The standard embodiment of the sensor is depicted in FIG. 1 consisting of a collimated light source such as a laser 1 shining downwards towards a mirror 2 mounted on a motor 3 shaft at such an angle that the light from the laser reflected from the mirror will shine radially outward from the centerline of the cone 7. An optical diffuser 4 is positioned in a cylindrically shaped configuration beyond the annular shaped region in which objects fall from the edge 20 of the cone 7. Multiple discrete sensors 5 are positioned in a ring concentric with the cylindrical diffuser 4, radially outward from the cylindrically shaped diffuser 4. The outputs of all the discrete sensors 5 are summed together in a virtual earth configuration. The motor 3 rotates the mirror 2 such that the laser 1 beam completes a radial sweep of the entire annular sensing region in less than half the time than it takes an object to fall through the sensing plane. An object 10 falling through the sensing region will therefore inhibit the light beam from the laser 1 from reach the diffuser 4 and ultimately the optical sensors 5 during the time span that the light beam impinges on the object 10 falling through the sensing region.

Sensor Embodiment Two

Figure 2A:
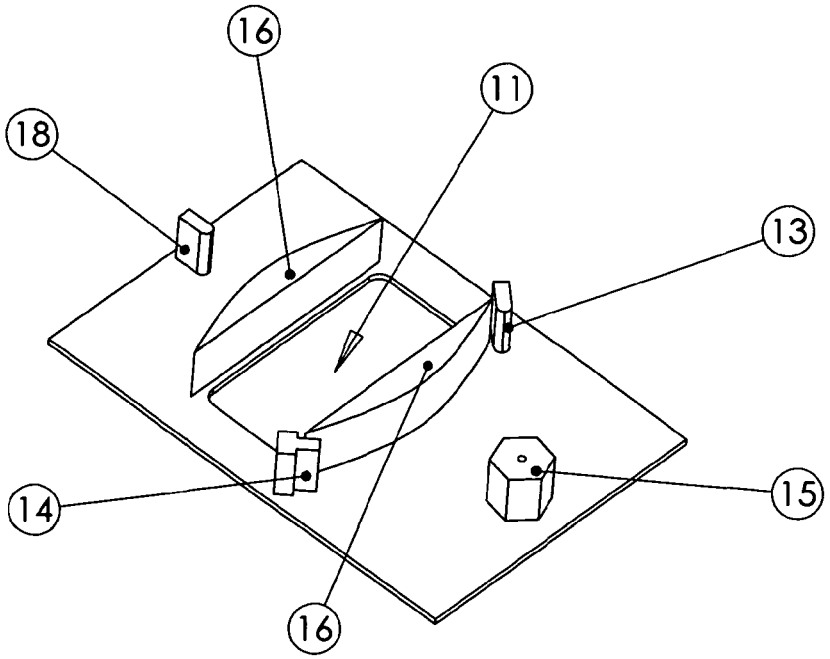
FIG. 2*a* Isometric view of an alternative embodiment of the optical sensor.
Figure 2B:
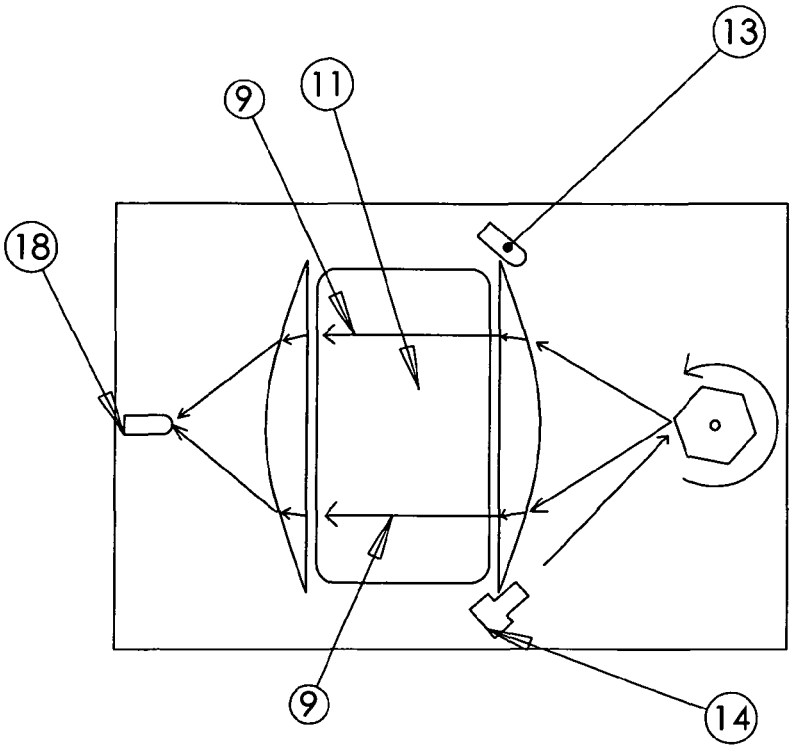
FIG. 2*b* Orthogonal plan view of an alternative embodiment of the optical sensor, showing the path followed by the sweeping laser beam.

FIG. 2*a* and FIG. 2*b* respectively shows the isometric and orthogonal plan view of a sweeping light beam based sensor system. A collimated light source 14 such as a laser shines a beam of light against a rotating mirror 15 such as the hexagonal rotating mirror illustrated in FIG. 2*a*, and FIG. 2*b*. The light beam reflected from the laser executes a sweeping arc towards a cylindrical convex lens 11. Lens 11 redirects the lens to sweep parallel across a sensing region 11 as depicted by the light beam lines 9. A second cylindrical convex lens focuses the light that has traversed the sensing region on to a single photo receiver 18. Once the light beam has completed sweeping across the entire sensing region the light finally strikes a second optical sensor 13 positioned beside the first cylindrical convex lens. The signal from this sensor provides the necessary synchronization pulse needed by the signal processor. As a new facet on the rotating mirror 15 is brought inline with the laser beam the light beam once again repeats its sweeping path across the sensing region 11.

Sensor Embodiment Three

An alternative embodiment of the sensors is illustrated in FIG. 3*a,b,c,d*. Linear optical sensor arrays capable of individual pixel resolution are used, 12 in FIG. 3*a,b,c* falling objects are separated by cone 7, FIG. 3*d* which then slide over the edge 20 thereby passing through the scanned optical plane of the respective modules. The image is focused onto the linear optical sensor array with lens 17, FIG. 3*a,b,c* by electronically scanning out the linear optical sensor arrays and further processing, falling objects obscuring the beam may be counted. Due to optical restrictions, three sensor modules are placed at 120 degree concentric positions to cover the entire 360 degree angle as indicated in FIG. 3*b,c,d*. FIG. 3*d* shows the cone 7, cone edge 20 and support pillars 19. The support pillar serves two purposes; the first being to physically support the optical sensor assembly and dispersion cone 7 within the interior of the overall system. The second purpose of the support pillars are to separate the flow of objects to be counted into three general regions thereby preventing objects from falling within the cross-over region between two the sensor assemblies FIG. 3*a*. Although refractive lenses were chosen to illustrate the invention, those skilled in the art will recognize that catodioptric lenses may alternatively be employed to project imagery from the from a wide angle circular region onto a linear optical sensing array such as a CCD.

Sensor Embodiment Four

The fourth sensor embodiment bares significant similarity to sensor embodiment one, however the light source and sensor locations are inverted. In sensor embodiment four one single sensor is placed above the rotating mirror 2. A ring of light shining towards the rotating mirror is placed radially outward from the annular sensing region. A focusing lens is placed in between the rotating mirror 2 and the optical sensor mounted above.

Processing Algorithm:

The algorithm used to process the optical and electrical signals are explained as it pertains to sensor embodiment one outlined before, however with minor alterations can be adapted to suit sensor embodiment two, three and four.

A high speed signal processor receives the single electrical signal from the collective output of all the optical sensors 5 surrounding the diffuser that were summed together. The processor receives a sync pulse signal input from the motor 3 each time the motor 3 turns through a predetermined angular position such as when the light beam starts its sweep from the support arm 19. The processor monitors the optical sensor output so as to discern when an object is obscuring the light beam. A counter timer is reset each time the sync pulse is received thus indicating that a new revolution is about to commence. During the subsequent 360 degree sweep each time the optical signal transitions in accordance with the start and end of an object, the processor stores the counter value, thereby keeping a time based log of the start and end of each object. Based on the period of successive sync pulses the time based log is normalized to derive the physical position that corresponds to the start and end of each object detected within a given sweep. Two buffers are used to store the positions of objects. Positions of objects detected are stored in one specific buffer during the entirety of one revolution. At the conclusion of the revolution the processor will switch buffers such that positions of the subsequent revolution will be stored in the other buffer. Hence one buffer can be considered the real-time storage buffer during which time the other buffer will hold the positions detected from the previous revolution and will be the transfer buffer. Upon the completion of the revolution the processor will switch the two buffers such that positions detected in the new revolution will be stored in what was considered the transfer buffer during the previous revolution, whereas the buffer that was considered the live-buffer during the previous revolution will be the transfer buffer for the entirety of the present revolution. At the conclusion of each revolution the processor toggles the two buffers as explained, and starts comparing entries from the transfer buffer to a running log. The width and position of each object read from the transfer buffer is compared to previous results stored in the record. A match in identity of each object based on location and width is searched for. The number of times that one object has been detected is recorded as well as many other metrics that can be used to analyze the objects. An interrupt triggered from the optical signal input is utilized to facilitate multitasking in the event that an object is detected before the processor has completed transferring object positions from the transfer buffer to the running record before the first object is detected. Once the processor has completed comparing and transferring object positions from the transfer buffer to the record the processor verifies if an object was present in the record that was not detected during the previous revolution. This would imply that the object has proceeded beyond the sensing region towards the collection tray 8. Each time the processor detects an object leaving the sensing region the overall counter is incremented and the new total number of objects counted is displayed to the user. The overall running volume of the objects counted is derived by adding the overall widths added together. The system displays on a real-time running basis the appropriate size container that would be needed to accommodate the objects counted. Those skilled in the art will recognize that some of the elements of the aforementioned algorithm could be revised to provide a viable alternative algorithm, however any such revisions are merely variations of the invention described in this invention. An example of one variation is to obtain a sync pulse by extracting one of the optical sensors 5 from FIG. 1*a* before the individual sensor output is summed with all the other optical sensors 5 within the ring.

Alternative Applications:

The exceptionally accurate counting at high throughput speed of this invention also makes it appealing to applications in industrial batch counting and packaging. In an automated batch counting and packaging environment this invention could be incorporated into an extended system consisting of other peripheral machines such as vibratory bowls, pouch forming machines, bottle unscramblers, bottle cappers etc. In such applications interfacing to this invention may take place over industry standard protocols such as ethernet, bus networks etc.

What is claimed and desired to be secured by Letters of Patent is as follows:

1. A small object counting device for counting and inspecting a plurality of small objects, comprising:

A. a funnel shaped hopper for receiving said plurality of small objects, wherein said hopper comprises a wide top and a narrow bottom and wherein said hopper further comprises a hopper opening at said narrow bottom, B. a cone comprising a pointed cone top and a wide cone bottom, wherein said pointed cone top is positioned below said hopper opening, wherein said plurality of small objects are separated and dispersed along the top surface of said cone and wherein said plurality of small objects fall off the edge at said wide cone bottom, C. a counting plane positioned below said wide cone bottom wherein said plurality of small objects are counted as they fall through said counting plane, said counting plane comprising:

1. an optical transmitter for transmitting an optical signal,
2. an optical sensor for receiving said optical signal,
3. a rotating mirror, wherein said optical transmitter is placed adjacent said rotating mirror, wherein light from said optical transmitter is reflected by said rotating mirror radially outward, and
4. a cylindrical diffuser concentric with said rotating mirror wherein light from said rotating mirror shines through said cylindrical diffuser, wherein said optical sensor is a plurality of sensors positioned cylindrically outward of said diffuser wherein said plurality of sensors receives light from said rotating mirror, D. a signal processor connected to said optical sensor, wherein when one of said plurality of small objects blocks the optical signal from reaching said optical sensor, said signal processor adds one more to the total count of said plurality of small objects, and E. a collection area for collecting said plurality of small objects after they fall through said counting plane and are counted by said signal processor.

2. A small object counting device for counting and inspecting a plurality of small objects, comprising:

A. a funnel shaped hopper for receiving said plurality of small objects, wherein said hopper comprises a wide top and a narrow bottom and wherein said hopper further comprises a hopper opening at said narrow bottom, B. a cone comprising a pointed cone top and a wide cone bottom, wherein said pointed cone top is positioned below said hopper opening, wherein said plurality of small objects are separated and dispersed along the top surface of said cone and wherein said plurality of small objects fall off the edge at said wide cone bottom, C. a counting plane positioned below said wide cone bottom wherein said plurality of small objects are counted as they fall through said counting plane, said counting plane comprising:

1. an optical transmitter for transmitting an optical signal,
2. an optical sensor for receiving said optical signal,
3. a rotating mirror, wherein said optical sensor is placed adjacent said rotating mirror, wherein said optical transmitter is a ring of light placed radially outward from said rotating mirror and shining towards said rotating mirror, and
4. a focusing lens placed between said rotating mirror and said optical sensor, D. a signal processor connected to said optical sensor, wherein when one of said plurality of small objects blocks the optical signal from reaching said optical sensor, said signal processor adds one more to the total count of said plurality of small objects, and E. a collection area for collecting said plurality of small objects after they fall through said counting plane and are counted by said signal processor.

3. A small object counting device for counting and inspecting a plurality of small objects, comprising:

A. a funnel shaped hopper for receiving said plurality of small objects, wherein said hopper comprises a wide top and a narrow bottom and wherein said hopper further comprises a hopper opening at said narrow bottom, B. a cone comprising a pointed cone top and a wide cone bottom, wherein said pointed cone top is positioned below said hopper opening, wherein said plurality of small objects are separated and dispersed along the top surface of said cone and wherein said plurality of small objects fall off the edge at said wide cone bottom, C. a counting plane positioned below said wide cone bottom wherein said plurality of small objects are counted as they fall through said counting plane, said counting plane comprising:

1. an optical transmitter for transmitting an optical signal,
2. an optical sensor for receiving said optical signal, wherein said optical transmitter covers a circular plane of 360 degrees and wherein said optical sensor is a linearly resolved optical receiver system that monitors said counting plane for the occurrence of said plurality of small objects passing through said counting plane, D. a signal processor connected to said optical sensor, wherein when one of said plurality of small objects blocks the optical signal from reaching said optical sensor, said signal processor adds one more to the total count of said plurality of small objects, and E. a collection area for collecting said plurality of small objects after they fall through said counting plane and are counted by said signal processor.

4. The small object counting device as in claim 3, wherein said optical transmitter transmits a narrow optical light beam directed to sweep across said counting plane, wherein said optical sensor is a collecting optical receiver positioned on the opposing side of said counting plane and wherein said collecting optical receiver collects said narrow optical light beam and converts said light beam to an electrical signal for processing by said signal processor.

5. The small object counting device as in claim 3, wherein said signal processor comprises two software buffers for storing said electrical signal data received from said optical sensor, wherein said two software buffers are toggled at the end of each complete scan of said counting plane, wherein data is sequentially logged to one of said two buffers while data is manipulated and transferred to a record from the other said buffer, and wherein data from the record is processed to display the quantity of objects counted.

6. A small object counting device for counting and inspecting a plurality of small objects, comprising:

A. a funnel shaped hopper for receiving said plurality of small objects, wherein said hopper comprises a wide top and a narrow bottom and wherein said hopper further comprises a hopper opening at said narrow bottom, B. a cone comprising a pointed cone top and a wide cone bottom, wherein said pointed cone top is positioned below said hopper opening, wherein said plurality of small objects are separated and dispersed along the top surface of said cone and wherein said plurality of small objects fall off the edge at said wide cone bottom, C. a counting plane positioned below said wide cone bottom wherein said plurality of small objects are counted as they fall through said counting plane, said counting plane comprising:

1. an optical transmitter for transmitting an optical signal,
2. an optical sensor for receiving said optical signal, wherein said optical transmitter covers a circular plane of 360 degrees and wherein said optical sensor is a linearly resolved optical receiver system that monitors said counting plane for the occurrence of said plurality of small objects passing through said counting plane, D. a signal processor connected to said optical sensor, wherein when one of said plurality of small objects blocks the optical signal from reaching said optical sensor, said signal processor adds one more to the total count of said plurality of small objects, wherein said signal processor comprises:

1. a pair of toggled buffers used for real time data logging and previous scan data manipulation,
2. a means for conducting a sequential end of scan manipulation and evaluation of accumulated data, and
3. a means for manipulating data over multiple scans using time obtained from sequential slices, and E. a collection area for collecting said plurality of small objects after they fall through said counting plane and are counted by said signal processor.

* * * * *